US011336033B2

(12) United States Patent
Guitard et al.

(10) Patent No.: US 11,336,033 B2
(45) Date of Patent: May 17, 2022

(54) SOCKET FOR SHIELDED CONNECTOR

(71) Applicants: LEGRAND SNC, Limoges (FR); LEGRAND FRANCE, Limoges (FR)

(72) Inventors: Julien Guitard, Saint Antoine l'Abbaye (FR); Vincent Grigis, Notre Dame de l'Osier (FR)

( * ) Notice: Subject to any disclaimer, the term of this patent is extended or adjusted under 35 U.S.C. 154(b) by 0 days.

(21) Appl. No.: 17/276,123

(22) PCT Filed: Jul. 1, 2019

(86) PCT No.: PCT/FR2019/051624
§ 371 (c)(1),
(2) Date: Mar. 12, 2021

(87) PCT Pub. No.: WO2020/053489
PCT Pub. Date: Mar. 19, 2020

(65) Prior Publication Data

US 2022/0037808 A1 Feb. 3, 2022

(30) Foreign Application Priority Data

Sep. 13, 2018 (FR) ..... 1858229

(51) Int. Cl.
*H01R 13/58* (2006.01)
*H01R 4/242* (2018.01)
(Continued)

(52) U.S. Cl.
CPC ..... *H01R 4/242* (2013.01); *H01R 13/501* (2013.01); *H01R 13/6589* (2013.01)

(58) Field of Classification Search
CPC ... H01R 13/5812; H01R 13/595; H01R 35/02
(Continued)

(56) References Cited

U.S. PATENT DOCUMENTS 4,836,791 A * 6/1989 Grabbe ..... H01R 12/00 439/79
4,992,052 A * 2/1991 Verhoeven ..... H01R 12/721 439/62

(Continued)

FOREIGN PATENT DOCUMENTS

DE 202012100261 U1 12/2012
FR 2942570 A1 8/2010
WO 2020053489 A1 3/2020

OTHER PUBLICATIONS

Foreign Communication from a Related Counterpart Application, International Search Report dated Oct. 24, 2019, International Application No. PCT/FR2019/051624 filed on Jul. 1, 2019.

(Continued)

*Primary Examiner* — Phuong Chi Thi Nguyen

(57) ABSTRACT

The invention concerns a connector-type socket comprising: —a body suitable for being connected via a front face to a complementary plug comprising a plurality of insulation-displacement contacts oriented in the same direction; —a separate connection module comprising a plurality of positions each intended to receive one end of a strand of a cable comprising shielding, the module being arranged in such a way as to be inserted into the body so as to bring each strand against the corresponding insulation-displacement contact; the socket being characterised in that the body comprises two separate parallel plates, each plate comprising a row of contacts, each row of contacts being arranged in a plane (P), the planes (P) containing the rows being separate from and parallel to each other such that all the strands of the cable can be connected in a single movement.

10 Claims, 2 Drawing Sheets

(51) Int. Cl.
*H01R 13/6589* (2011.01)
*H01R 13/50* (2006.01)

(58) Field of Classification Search
USPC ..... 439/460
See application file for complete search history.

(56) References Cited

U.S. PATENT DOCUMENTS

| | | | | |
|---|---|---|---|---|
| 5,094,623 | A * | 3/1992 | Scharf | H01R 12/00 439/101 |
| 5,104,329 | A * | 4/1992 | Brown | H01R 12/716 439/108 |
| 6,116,964 | A | 9/2000 | Goodrich et al. | |
| 10,574,002 | B1 * | 2/2020 | Henry | H01R 13/6587 |

OTHER PUBLICATIONS

Foreign Communication from a Related Counterpart Application, Written Opinion dated Oct. 24, 2019, International Application No. PCT/FR2019/051624 filed on Jul. 1, 2019.

* cited by examiner

SOCKET FOR SHIELDED CONNECTOR

CROSS-REFERENCE TO RELATED APPLICATIONS

The present application is a filing under 35 U.S.C. 371 as the National Stage of International Application No. PCT/FR2019/051624, filed Jul. 1, 2019, entitled "SOCKET FOR SHIELDED CONNECTOR," which claims priority to French Application No. 1858229 filed with the Intellectual Property Office of France on Sep. 13, 2018 both of which are incorporated herein by reference in their entirety for all purposes.

TECHNICAL FIELD OF THE INVENTION

The invention relates to the field of computer and telecommunication network connectors. It relates more particularly to a connector socket, for example an RJ45 connector, comprising a plurality of wires. Such a connector is typically intended to be used in a cross-connect panel, in particular in a high-density cross-connect panel.

Increasing the throughput via RJ45 type cables and connectors particularly necessitates increasing the number of wires while retaining the same footprint. Moreover, increasing throughputs also necessitates improving the protection of the connector against electromagnetic disturbances generated by the connector itself.

PRIOR ART

The document U.S. Pat. No. 6,116,964 discloses a communication connector assembly capable of responding to the category 6 performance levels proposed with respect to the final crosstalk. The assembly comprises a metallic plate having a front part and a certain number of elongated terminal contact wires with base parts connected to one end of a card, and free end parts for electrically contacting a homologous connector. The terminal contact wires extend in parallel and are coplanar with one another above the front part of the card, and the free end parts thereof protrude from the front part of the card. The free end parts are configured to be elastically deflected towards the card when the corresponding connector engages them in a parallel direction to the card. A crosstalk compensation device is associated with at least one of the terminal contact wires in a position where the wires are coplanar with one another. This type of connector does not permit a simplified connection of the strands in the connector. Moreover, no ground connection is provided in this type of connector.

AIM OF THE INVENTION

The socket for a shielded connector according to the invention is intended to remedy all or some of the drawbacks of the prior art and is particularly intended to propose a connector having a very low crosstalk level. Moreover, a further aim of the invention is that of proposing a connector socket ensuring a satisfactory shielding level.

SUMMARY OF THE INVENTION

The invention relates to a connector-type socket comprising:

- a body capable of being connected via a front face to a complementary plug and including a plurality of insulation-displacement contacts oriented in the same direction;

- a separate connection module including a plurality of slots each intended to receive one end of a strand of a cable comprising shielding, the module being arranged in such a way as to be inserted into the body so as to bring each strand against the corresponding insulation-displacement contact; the socket being characterised in that the body comprises two separate and parallel plates, each plate comprises a row of contacts, each row of contacts is arranged in a plane, the planes containing the rows being separate from and parallel to each other so as to be able to connect all the strands of the cable in a single movement.

Thus, the insulation-displacement contacts are offset in the longitudinal axis of the body which enables a quasi-simultaneous connection of all the strands of the shielded cable.

According to a further feature, the connection module comprises a separating wall of two pairs of slots, the socket further comprising a linking element comprising an electrical contact zone with respectively the separating wall, the shielding of the cable, and the body.

The linking element and the separating walls make it possible to provide the shielding of each pair of strands.

According to a further feature, the linking element surrounds the connection module.

According to a further feature, the contacts of the plates are oriented in a perpendicular direction to the plates.

According to a further feature, the connection module comprises two separating walls to form four compartments each comprising a pair of slots.

According to a further feature, the two separating walls are perpendicular and one of the separating walls is parallel to the plates, the linking element comprising an electrical contact zone with each of the separating walls.

According to a further feature, the linking element comprises a first and a second parts, each part comprising an electrical contact zone (31, 34) with the separating wall.

According to a further feature, the body comprises a base (16) wherein the connection module is inserted and a lever pivotally mounted on the base arranged for locking the module on the base, the linking element being rigidly connected to the base and/or the lever, the lever providing an electrical contact with the base.

According to a further feature, the first part of the linking element is mounted in the lever and comprises a contact zone with the lever, the second part is mounted in the base and comprises an electrical contact zone with the base.

According to a further feature, each plate comprises four contacts (11).

According to a further feature, wherein the plates are mounted on a support plate perpendicular to the longitudinal axis of the body.

According to a further feature, the planes containing the rows (15) are perpendicular to the axis of the cable.

BRIEF DESCRIPTION OF THE FIGURES

Further features and innovative advantages of the invention will emerge on reading the description hereinafter, provided by way of indication and not limitation, with reference to the appended drawings, wherein.

DETAILED DESCRIPTION OF AN EMBODIMENT

Figure 1:
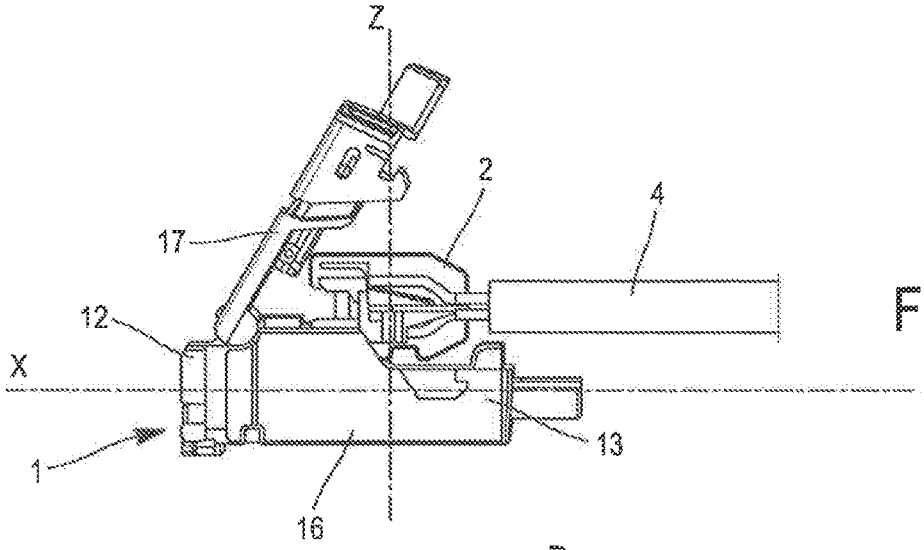
FIG. 1, represents an overall view of a socket according to the invention.
Figure 2:
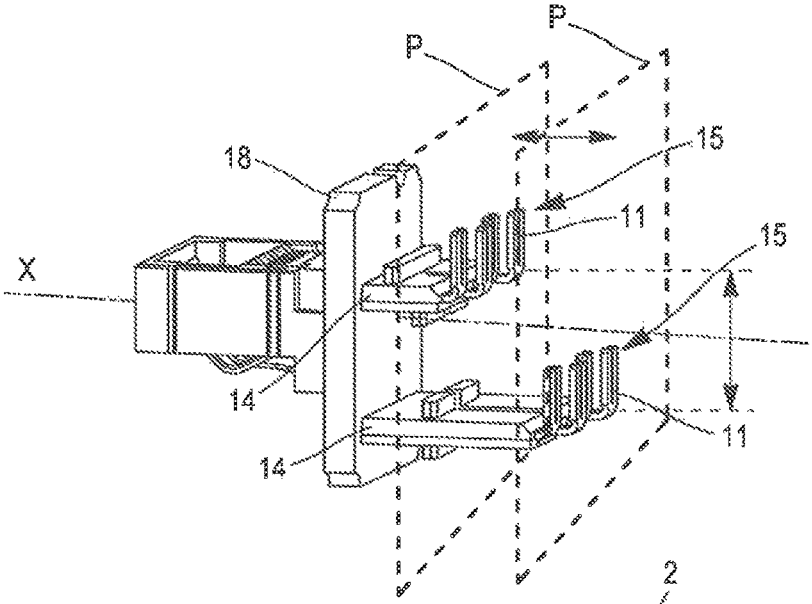
FIG. 2, represents a detailed view of the contact support of the socket according to the invention.

For more clarity, identical or similar elements are identified by identical reference signs in all of the figures. A numerical reference sign denotes a single or generic components. An adjoined literal sign specifies the particular component.

With reference to FIGS. 1 to 5, a socket according to an example of embodiment of the invention is represented with respect to a longitudinal axis X and a vertical axis Z. The socket represented is of RJ45 type. The invention relates more generally to computer and telecommunication network connector such as an RJ11, RJ12, RJ25, RJ45, ARJ45 or RJ48 connector.

The socket includes a body 1 and a connection module 2. The body 1 extends along the longitudinal axis X and includes a front face 12, the front being defined by the direction of the vector X. The front face 12 comprises an orifice intended to receive a plug complementary with the socket. The body 1 includes insulation-displacement contacts 11 intended to each receive a strand of a feed cable 4. All the insulation-displacement contacts 11 have the same orientation. The body 1 also includes a rear face 13, the rear being defined by the opposite direction to that of the vector X, intended to receive the connection module 2. The body also includes a base 16, intended to support a lever 17. The lever 17 also provides an electrical contact with the base 16.

The connection module 2 is a separate element from the socket body 1 including several slots 21 intended to each receive one end of a strand of the cable 4. The connection module 2 is arranged so as to be inserted into the base 16 of the body 1 in order to push each strand of the shielded cable 4 against the corresponding insulation-displacement contact. According to the alternative embodiment represented, the axis of the cable 4 is substantially parallel or merged with the longitudinal axis X of the body 1.

The lever 3 is pivotally mounted about an axis of the base 16. In the upper position, the lever 17 frees the space intended for the insertion of the connection module 2. The lowering of the lever 17 when the connection module 2 is inserted causes the displacement of the strands of the shielded cable 4 against the insulation-displacement contacts 11.

According to the invention, the insulation-displacement contacts 11 are mounted in the body 1 by means of at least two plates 14. These plates 14 are parallel with one another. The insulation-displacement contacts 11 are arranged substantially along rows 15. Each plate 14 comprises at least one row 15 of insulation-displacement contacts 11. According to the invention, each row 15 is arranged substantially in a plane P. The planes P containing the rows 14 are separate and parallel with one another. This specific arrangement makes it possible to offset the insulation-displacement contacts 11 along the longitudinal axis X and thus be able to connect all the insulation-displacement contacts 11 in a single movement for example, when operating the lever 17 when the connection module has been inserted into the base 16 of the socket body 1. It is therefore understood that the operation of connecting the strands of the shielded cable 4 is very simple.

According to the alternative embodiment shown, the planes P containing the rows 15 of insulation-displacement contacts 11 are also perpendicular to the axis of the cable 4.

According to an alternative embodiment, the insulation-displacement contacts 11 are oriented along a parallel direction to the plates 14. Similarly, according to a further alternative embodiment, the plates 14 are substantially parallel to the longitudinal axis X of the body 1. According to this alternative embodiment, the insulation-displacement contacts 11 are then oriented along the vertical axis Z. Moreover, according to the alternative embodiment of FIG. 2, the plates 14 are mounted on a support 18 to facilitate the assemblies thereof in the socket body 1. The socket according to the embodiment shown comprises 8 strands of shielded cable 4. In this configuration, each plate 14 comprises 4 insulation-displacement contacts 11.

Figure 3:
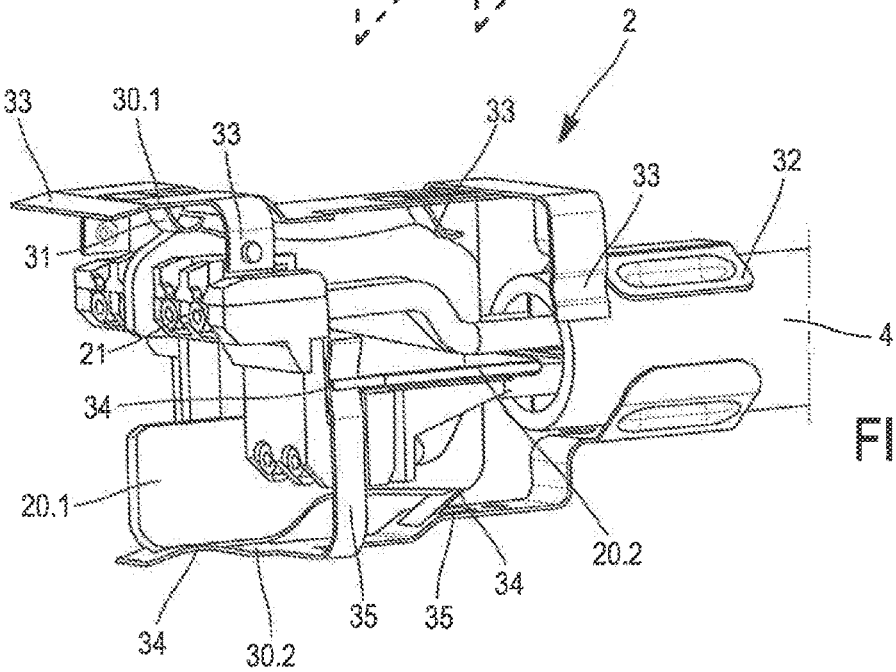
FIG. 3 represents a detailed view of the connection module of the socket according to the invention.
Figure 4:
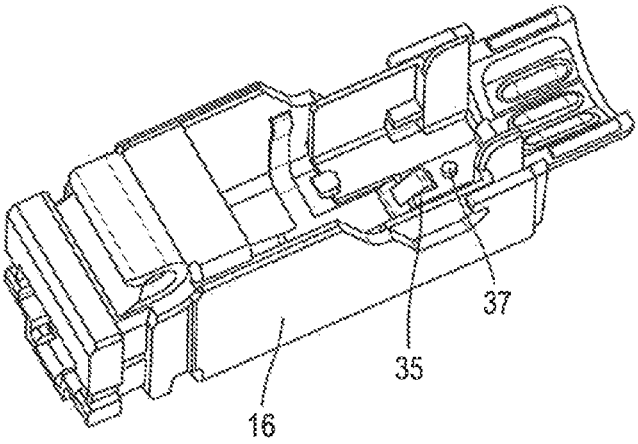
FIG. 4 represents a detailed view of the base of the body of the socket according to the invention.
Figure 5:
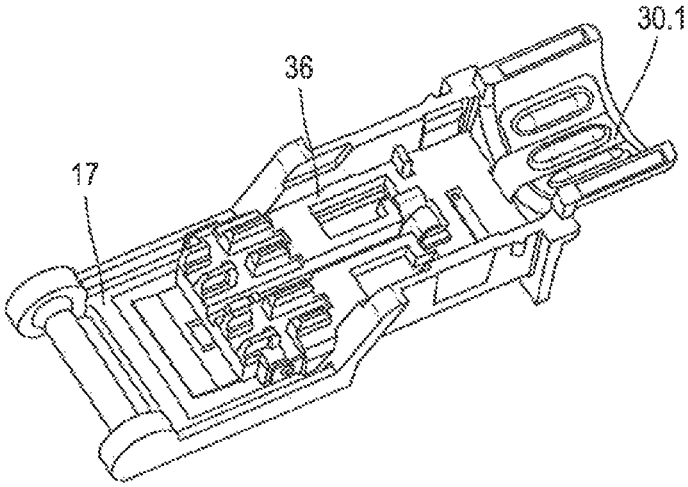
FIG. 5 represents a detailed view of the lever of the body of the socket according to the invention.

According to the alternative embodiment in FIG. 3, the connection module 2 comprises at least one separating wall 20.1, 20.2 for insulating at least two pairs of slots 21. Each slot receives a strand of the shielded cable 4. In other words, the separating walls 20.1 20.2 enable the partitioning of the strand pairs and therefore help limit interference and cross-talk between the strands of two pairs of adjacent strands. According to a further alternative embodiment, for a socket comprising 4 pairs of slots 21, two separating walls 20.1, 20.2 are configured, substantially forming a cross. A pair of slots is then positioned in each of the four sectors formed by the cross. Each pair of strands will then be insulated from another pair of adjacent strands. To limit the footprint and facilitate the insertion of the strands, the two walls 20.1, 20.2 are perpendicular.

Also with reference to FIG. 3, the connection module 2 also comprises a linking element 30.1, 30.2 providing at least one electrical contact zone 31, 32, 33, 34, 35 with respectively each separating wall 20.1, 20.2, the shielding of the cable 4, and the body 1.

Thus, it is understood that the linking element 30.1, 30.2 comprises at least one electrical contact zone 31, 34 with each separating wall 20.1, 20.2. Similarly, the linking element 30.1, 30.2 comprises at least one electrical contact zone 33, 35 with the body 1. And finally, the linking element 30.1, 30.2 comprises at least one electrical contact zone 32 with the shielding of the cable 4. Thus, the linking element makes it possible to carry out the shielding of each pair of strands present in the slots 21 of the connection module 2.

To simplify the shape of the linking element 30.1, 30.2, the latter can surround the connection module 2. Thus, the electrical contact zones 33, 35 between the linking element 30.1, 30.2 and the body 1 are easier to position.

The linking element can be made of two parts 30.1 30.2. Each of the parts comprises an electrical contact zone 31, 34 with all the separating walls 20.1, 20.2 so as to retain the shielding of each pair of slots 21. The first part 30.1 is mounted in the lever 17 of the body 1 for example by means of a plastic insert 36 also covering the connection module 2. The second part 30.2 of the linking element is mounted in the base 16 of the body 1 for example by means of a crimping 37.

The invention is described above by way of example. It is understood that a person skilled in the art is capable of embodying different alternative embodiments of the invention, by associating for example the different features above taken alone or in combination, without for all that leaving the scope of the invention.

The invention claimed is:

1. Connector-type socket comprising:

a body capable of being connected via a front face to a complementary plug and including a plurality of insulation-displacement contacts oriented in the same direction;

a separate connection module including a plurality of slots each intended to receive one end of a strand of a cable comprising shielding, the module being arranged in such a way as to be inserted into the body so as to bring each strand against the corresponding insulation-displacement contact; the socket being characterised in that the body comprises two separate and parallel plates, each plate comprises a row of contacts, each row of contacts is arranged in a plane (P) and the contacts of the plates being oriented in a perpendicular direction to the plates, the planes (P) containing the rows being separate from and parallel to each other so as to be able to connect all the strands of the cable in a single movement, the connection module comprising a separating wall of two pairs of slots, the socket further comprising a linking element comprising an electrical contact zone with respectively the separating wall, the shielding of the cable, and the body.

2. Socket according to claim 1, wherein the linking element surrounds the connection module.

3. Socket according to claim 1, wherein the linking element comprises a first and a second parts, each part comprising an electrical contact zone with the separating wall.

4. Socket according to claim 1, wherein each plate comprises four contacts.

5. Socket according to claim 1, wherein the plates are mounted on a support plate perpendicular to the longitudinal axis of the body.

6. Socket according to claim 1, wherein the planes (P) containing the rows are perpendicular to the axis of the cable.

7. Socket according to claim 1, wherein the connection module comprises two separating walls to form four compartments each comprising a pair of slots.

8. Socket according to claim 7, wherein the two separating walls are perpendicular and one of the separating walls is parallel to the plates, the linking element comprising an electrical contact zone with each of the separating walls.

9. Socket according to claim 1 wherein the body comprises a base wherein the connection module is inserted and a lever pivotally mounted on the base arranged for locking the module on the base, the linking element being rigidly connected to the base and/or the lever.

10. Socket according to claim 9, wherein the first part of the linking element is mounted in the lever and comprises a contact zone with the lever, the second part is mounted in the base and comprises an electrical contact zone with the base, the lever providing an electrical contact with the base.

* * * * *